US007148865B2

(12) United States Patent
Tamaki

(10) Patent No.: US 7,148,865 B2
(45) Date of Patent: Dec. 12, 2006

(54) DISPLAY DEVICE USING LIGHT-EMITTING ELEMENTS

(75) Inventor: Takashi Tamaki, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 232 days.

(21) Appl. No.: 10/302,950

(22) Filed: Nov. 25, 2002

(65) Prior Publication Data

US 2003/0122750 A1 Jul. 3, 2003

(30) Foreign Application Priority Data

Dec. 28, 2001 (JP) ..... 2001/401068

(51) Int. Cl.
*G09G 3/30* (2006.01)
*G09G 3/32* (2006.01)

(52) U.S. Cl. ..... 345/82; 345/77

(58) Field of Classification Search ..... 345/82, 345/77

See application file for complete search history.

(56) References Cited

U.S. PATENT DOCUMENTS

| | | | | |
|---|---|---|---|---|
| 5,923,309 | A * | 7/1999 | Ishizuka et al. | 345/82 |
| 6,717,559 | B1 * | 4/2004 | Weindorf | 345/82 |
| 6,756,951 | B1 * | 6/2004 | Ishizuka et al. | 345/82 |
| 6,771,235 | B1 * | 8/2004 | Ishizuka et al. | 345/77 |
| 6,897,837 | B1 * | 5/2005 | Sakumoto et al. | 345/76 |

FOREIGN PATENT DOCUMENTS

| | | |
|---|---|---|
| JP | 05-216425 | 8/1993 |
| JP | 06301355 | 10/1994 |
| JP | 08-146916 | 6/1996 |
| JP | 2000221944 | 8/2000 |
| JP | 2001-500995 | 1/2001 |
| JP | 2001-083937 | 3/2001 |
| JP | 2001083930 | 3/2001 |
| JP | 2001083937 | 3/2001 |

* cited by examiner

*Primary Examiner*—Kee M. Tung
*Assistant Examiner*—Motilewa Good-Johnson
(74) *Attorney, Agent, or Firm*—VolentineFrancos& Whitt,PLLC

(57) ABSTRACT

Display device wherein change of the amount of light of the light-emitting elements caused by change of the number of light-emitting elements that emit light simultaneously is small. This display device includes a display panel having light-emitting elements arranged in matrix fashion; data lines for applying anode potential to light-emitting elements of the same column; scanning lines for applying cathode potential to light-emitting elements of the same row; and a control circuit that adjusts voltage between the anode and cathode of the light-emitting elements based on the number of light-emitting elements that emit light simultaneously. The control circuit suppresses changes of voltage between the anode and cathode of the light-emitting elements caused by a change in the number of light-emitting elements that emit light simultaneously. Accordingly, change of the amount of light of the light-emitting elements is suppressed.

25 Claims, 7 Drawing Sheets

DISPLAY DEVICE USING LIGHT-EMITTING ELEMENTS

BACKGROUND OF THE INVENTION

1. Field of the Invention

The present invention relates a display device using organic electroluminescence elements, light-emitting diodes or other similarly light-emitting elements. More particularly, the present invention relates to a display device having a driving circuit which can suppresses changes of light emission intensity of the light emitting elements.

2. Description of the Related Art

Display devices are known employing for example organic EL (electroluminescence) elements. Organic EL elements can be driven with low DC voltage. In addition, organic EL elements are light-emitting elements, so, compared with optically transparent elements such as liquid-crystal elements, they provide a wide field of view angle, a bright display surface and are of small thickness and light weight. Organic EL elements can therefore be employed as large-capacity display devices for various applications.

A technique for driving organic EL display devices is disclosed in for example Japanese Laid-open publication number 301355/1994.

The electrical characteristic of an organic EL element is disclosed in FIG. 7 of this publication. An organic EL element emits light when current flows in the forward direction between the anode and cathode. However, the light emission intensity of an organic EL element depends not merely on the current between the anode and cathode but also on the voltage between the anode and cathode. Consequently, in order to match the light emission intensity of the organic EL element accurately with the design value, it is necessary to control both the current and the voltage between the anode and cathode.

An organic EL display device comprises a large number of organic EL elements arranged in matrix fashion. With such a construction, when a large number of organic EL elements emit light simultaneously, the amount of current flowing to ground becomes very large. The cathode potential of the organic EL elements therefore rises, due to the internal resistance of the drive circuit. Consequently, the voltage between the anode and cathode of the individual organic EL elements is decreased. That is, the light emission intensity of the individual organic EL elements may be lowered due to a large number of organic EL elements emitting light simultaneously.

SUMMARY OF THE INVENTION

An object of the present invention is to provide a display device wherein the change of the amount of light of the light-emitting elements caused by change of the number of light-emitting elements that emit light simultaneously is small.

For this purpose, a display device according to the present invention comprises: a display panel comprising light-emitting elements arranged in matrix fashion; a plurality of data lines that apply anode potential to light-emitting elements of the same column; a plurality of scanning lines that apply cathode potential to light-emitting elements of the same row; and a control circuit that adjusts the voltage between the anode and cathode of the light-emitting elements in accordance with the number of light-emitting elements that emit light simultaneously.

The control circuit suppresses change of the voltage between the anode and cathode of the light-emitting elements caused by change of the number of light-emitting elements that emit light simultaneously. In this way, change of the amount of light of the light-emitting elements is suppressed.

BRIEF DESCRIPTION OF THE DRAWINGS

Other objects and advantages of the present invention will be described with reference to the appended drawings.

DESCRIPTION OF THE PREFERRED EMBODIMENTS

Figure 1A:
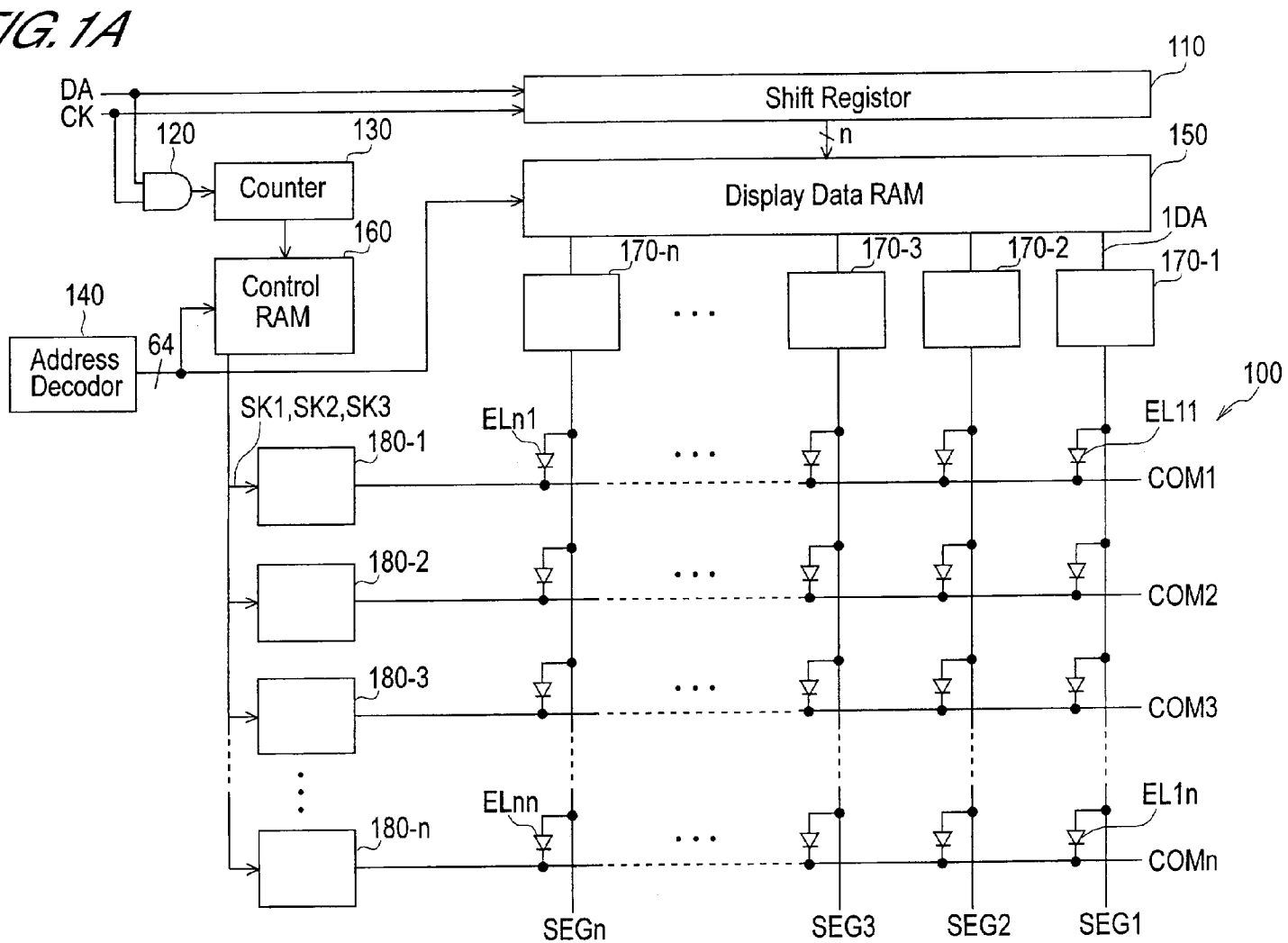
FIG. 1A is a circuit diagram illustrating the overall layout of a display device according to a first embodiment.

Embodiments of the present invention are described below with reference to the drawings. In the drawings, the size of the various constituent components, their shape and arrangement relationships are shown only diagrammatically to a degree such as to enable the present invention to be understood; also, numerical conditions described below are given merely by way of example.

First Embodiment

Figure 1B:
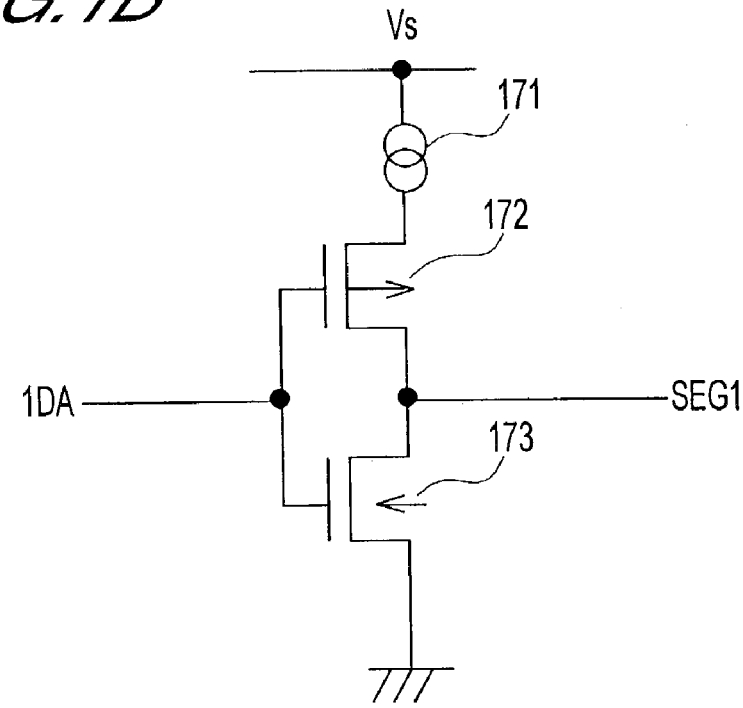
FIG. 1B is a circuit diagram illustrating an example layout of a positive electrode output circuit illustrated in FIG. 1A.
Figure 1C:
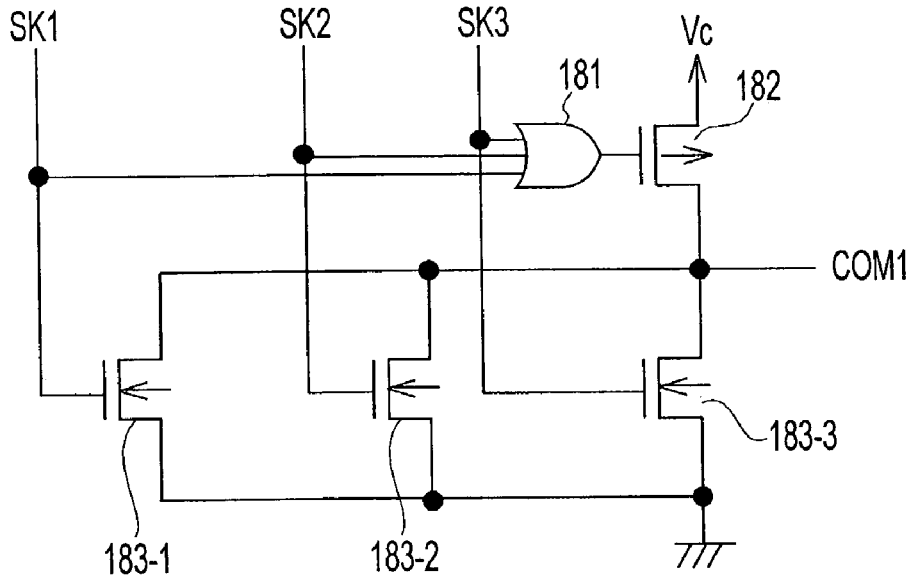
FIG. 1C is a circuit diagram illustrating an example layout of a negative electrode output circuit illustrated in FIG. 1A.

FIG. 1A to FIG. 1C are circuit diagrams illustrating the layout of a display device according to a first embodiment of the present invention.

As shown in FIG. 1A, this matrix type display device comprises a display panel 100, a shift register 110, AND gate 120, display number counter 130, address decoder 140, display data RAM (random access memory) 150, negative electrode control RAM 160, positive electrode output circuits 170-1 to 170-n and negative electrode output circuits 180-1 to 180-n.

Display panel 100 comprises n×n (for example 128×128) organic EL elements EL11 to ELnn, data lines SEG1 to SEGn and scanning lines COM1 to COMn. EL elements of the same column are connected with the same data line. Also, EL elements of the same row are connected with the same scanning line.

Shift register 110 inputs serial display data DA with a timing supplied by clock CK and converts the data DA into n-bit parallel signals. In the display data of the present embodiment, high-level indicates "ignited" and low-level indicates "not ignited".

AND gate 120 inputs the display data DA and clock signal CK, and outputs the logical product of these signals.

Display number counter 130 inputs the output signal of AND gate 120 and counts the number of high-level signals. The count result is output. The output count value indicates the number of "ignited" data items in the display data of a single row.

Address decoder 140 outputs for example a 64-bit address signal A to display data RAM 150 and negative electrode control RAM 160. Address signal A is employed as the write address and read address of RAM 150 and 160.

Display data RAM 150 stores the display data DA that is input from shift register 110. In addition, display data RAM 150 outputs the bits of the storage data to positive electrode output circuits 170-1 to 170-n.

Negative electrode control RAM 160 stores the count value of display number counter 130. Also, negative electrode control RAM 160 generates a negative electrode control signal using this stored value and outputs this to negative electrode output circuits 180-1 to 180-n. 3-bit negative electrode control signals are supplied to each of the negative electrode output circuits 180-1 to 180-n. The negative electrode control signals SK1, SK2, SK3 that are supplied to negative electrode output circuits 180-1 are shown in FIG. 1. There are no particular restrictions on the method of determining the value of the negative electrode control signal. In this embodiment, when the count value is 1 to 32, only signal SK1 is high-level; when the count value is 33 to 64, only signal SK2 is high-level; and when the count value is 65 or more, only signal SK3 is made high-level. With this method, negative electrode control signals SK1, SK2 and SK3 can be generated using only the most higher three bits of the count value. The negative electrode output circuits that are not selected are supplied with low-level negative electrode control signals which are also 3-bit.

Positive electrode output circuits 170-1 to 170-n input display data of corresponding bits from display data RAM 150. The bits of the display data DA are subjected to inverted value/DA conversion when they are written to RAM 150, before being input to positive electrode output circuits 170-1 to 170-n. Positive electrode output circuits 170-1 to 170-n output potentials corresponding to the values of the display data DA to the corresponding data lines to SEG1 to SEGn. As shown in FIG. 1B, positive electrode output circuit 170-1 comprises a constant-current element 171, a pMOS transistor 172 and an nMOS transistor 173. Constant-current element 171 inputs power source voltage Vs (for example 20 volt) being supplied for the data line and outputs a constant current. Constant-current element 171 is constituted by for example an MOS transistor of fixed gate potential. pMOS transistor 172 is connected at its source to the output of constant-current element 171, is connected at its drain to data line SEG1 and is connected at its gate with the lowest bit of display data RAM 150. Also, nMOS transistor 173 is connected at its source with the ground line, is connected at its drain with data line SEG1 and is connected at its gate with the lowest bit of display data RAM 150. Consequently, when the input display data/DA is low-level, positive electrode output circuit 170-1 outputs a prescribed high level voltage and when the input display data/DA is high-level potential outputs a prescribed low-level potential i.e. zero volts. The construction of the other positive electrode output circuits 170-2 to 170-n is the same as the construction of positive electrode output circuit 170-1.

The negative electrode output circuits 180-1 to 180-n discharge the current that is input from the cathodes of organic EL elements EL11 to ELnn through scanning lines COM1 to COMn to the ground line. The negative electrode output circuit 180-1 corresponding to scanning line COM1 adjusts the cathode potential of organic EL elements EL11 to Eln1 in accordance with the signals SK1, SK2 and SK3 that are input from negative electrode control RAM 160. As shown in FIG. 1C, negative electrode output circuit 180-1 comprises an OR gate 181, pMOS transistor 182 and three nMOS transistors 183-1, 183-2 and 183-3. OR gate 181 outputs the logical sum of signals SK1, SK2 and SK3. pMOS transistor 182 is connected at its source with power source Vc being supplied for the scanning line (for example 20 volt), is connected at its drain with scanning line COM1 and is connected at its gate with the output of OR gate 181. nMOS transistor 183-1 is connected at its source with the ground line, is connected at its drain with scanning line COM1 and inputs signal SK1 from its gate. nMOS transistor 183-2 is connected at its source with the ground line and at its drain is connected with scanning line COM1 and inputs signal SK2 from its gate. nMOS transistor 183-3 is connected at its source with the ground line, is connected at its drain with scanning line COM1 and inputs signal SK3 from its gate. The ratios of the ON resistances of nMOS transistors 183-1, 183-2, 183-3 may be selected at will. In this embodiment, the ratios of the ON resistances of nMOS transistors 183-1, 183-2 and 183-3 are set to 4:2:1. The ratios of the ON resistances can be set by the gate widths of nMOS transistors 183-1, 183-2, and 183-3, for example. The constructions of the other negative electrode output circuits 180-2 to 180-n are the same as the construction of negative electrode output circuit 180-1.

Next, the principles of operation of a display device according to this embodiment will be described using FIG. 1A to FIG. 1C and FIG. 2. Hereinbelow, the case where n=128 will be described by way of example.

Figure 2:
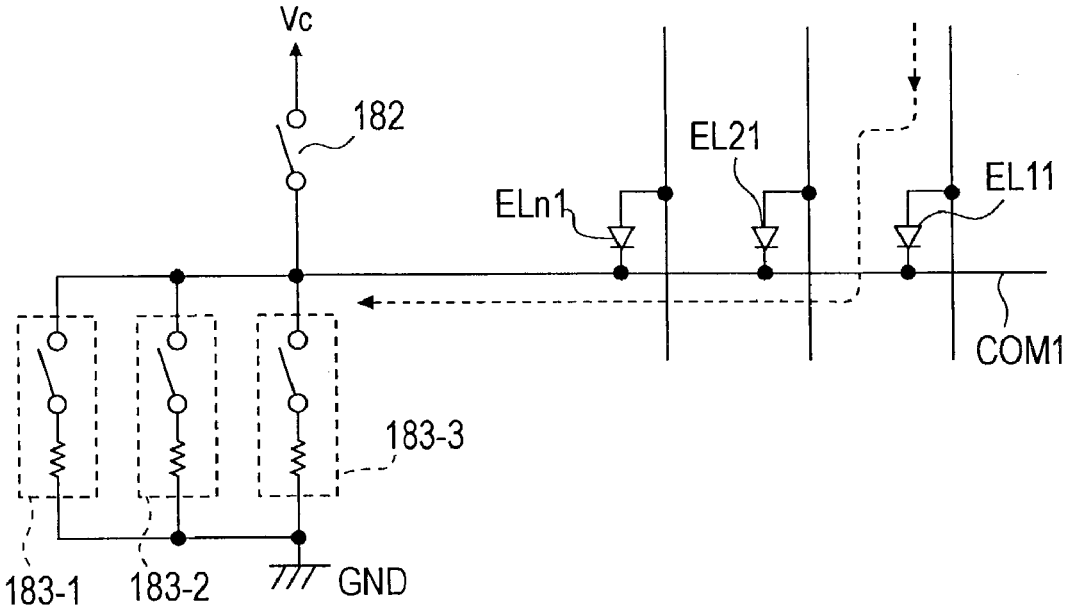
FIG. 2 is a diagram given in explanation of the operation of a drive circuit according to a first embodiment.

FIG. 2 is a concept diagram given in explanation of the operation of the display device illustrated in FIG. 1A to FIG. 1C.

First of all, the operation of reading display data DA will be described.

Display data DA is input to shift register 110 from outside in serial form synchronized with clock CK. The input display data DA is converted to data corresponding to one row worth of data, namely 128-bit parallel data. Simultaneously, display data DA in serial form and clock CK are also input to AND gate 120. The output of AND gate 120 is input to display number counter 130. As a result, the display number counter 130 counts the number of "ignition" data contained in one row of display data DA. The converted display data DA is sequentially stored in display data RAM 150 and the count value is simultaneously stored in negative electrode control RAM 160. The storage position of the display data and the storage position of the count value are determined in accordance with the address signal A that is output from address decoder 140.

Next, the operation of displaying the first row of display panel 100 will be described. The operation of displaying the second and subsequent rows of display panel 100 is the same as in the case of the first row.

Address decoder 140 outputs an address signal A corresponding to the display data of the first row. This address signal A is input to RAM 150 and 160. Display data RAM 150 outputs of 128-bit data/DA (i.e. the inverted value of the display data DA) corresponding to the address signal A to positive electrode output circuits 170-1 to 170-n. Also, negative electrode control RAM 160 outputs negative electrode control signals SK1, SK2 and SK3 to negative electrode output circuit 180-1.

Positive electrode output circuits 170-1 to 170-n (n=128) input the corresponding bits of data/DA. As described above, positive electrode output circuits 170-1 to 170-n output high level when data/DA is low level and output low level when the bit signal is high-level (see FIG. 1B). The outputs of positive electrode output circuits 170-1 to 170-n are applied to the anodes of the organic EL elements EL11, EL21, . . . , ELnn through data lines SEG1 to SEGn.

Negative electrode output circuit 180-1 inputs negative electrode control signals SK1, SK2 and SK3. pMOS transistor 182 turns OFF when any of negative electrode control signals SK1, SK2 and SK3 is high-level. Also, nMOS transistor 183-1 turns ON when signal SK1 is high-level, nMOS transistor 183-1 turns ON when signal SK2 is high-level and nMOS transistor 183-3 turns ON when signal SK3 is high-level. Low-level potential (ground potential) is therefore applied through scanning line COM1 to the cathodes of organic EL elements EL11, EL21, . . . , ELn1 of the first row.

As a result, forward voltage is applied to the organic EL elements whose anodes have high-level potential applied to them while the voltage between the anode and cathode of organic EL elements which have low-level potential applied to their anodes is zero volts. For example, when positive electrode output circuit 170-1 is outputting high level and the other positive electrode output circuits 170-2 to 170-n are outputting low level, organic EL element EL11, since forward voltage is being applied thereto, emits light, but the other organic EL elements do not emit light (see FIG. 2).

As described above, when the number of organic EL elements that are simultaneously ON is 1 to 32, only signal SK1 is high-level; when the number is 33 to 64, only signal SK2 is high-level; when it is 65 or more, only signal SK3 is high-level. Consequently, when the number of organic EL elements that are simultaneously ON is 1 to 32, only nMOS transistor 183-1 is turned ON; when the number is 33 to 64, only nMOS transistor 183-2 is turned ON; when it is 65 or more, only nMOS transistor 183-3 is turned ON. Also, as described above, the ratios of the ON resistances of nMOS transistors 183-1, 183-2 and 183-3 are set to 4:2:1. Consequently, if the ON resistance of an nMOS transistor is taken as R, the resistance of negative electrode output circuit 180-1 when the number of organic EL elements that are ON is 1 to 32 is 4R, when this number is 33 to 64 is 2R and when it is 65 or more is R.

The current that flows out to ground from scanning line COM1 through negative electrode output circuits 180-1 to 180-n becomes larger as the number of organic EL elements that are simultaneously ON is increased. As a result, if the resistance of negative electrode output circuit 180-1 is fixed, the amount of voltage drop of the negative electrode output circuit 180-1 increases as the number of organic EL elements that are simultaneously ON is increased, so the voltage between the anodes and cathode of the organic EL elements that are in the ON state becomes smaller. In contrast, with the display device of this embodiment, the resistance of negative electrode output circuit 180-1 becomes smaller as the number of organic EL elements that are simultaneously ON is increased. Consequently, with the display device of this embodiment, change of the voltage between the anode and cathode of the organic EL elements can be suppressed so, as a result, changes of light emission intensity of the organic EL elements can be suppressed.

In addition, this embodiment has the advantage that, since the resistance of negative electrode output circuits 180-1 to 180-n is controlled using display number counter 130 and negative electrode control RAM 160, the display device circuit layout can be simple.

In this embodiment, the resistance of negative electrode output circuits 180-1 to 180-n is controlled using three nMOS transistors 183-1 to 183-3, but four or more transistors could be employed.

Second Embodiment

Figure 3A:
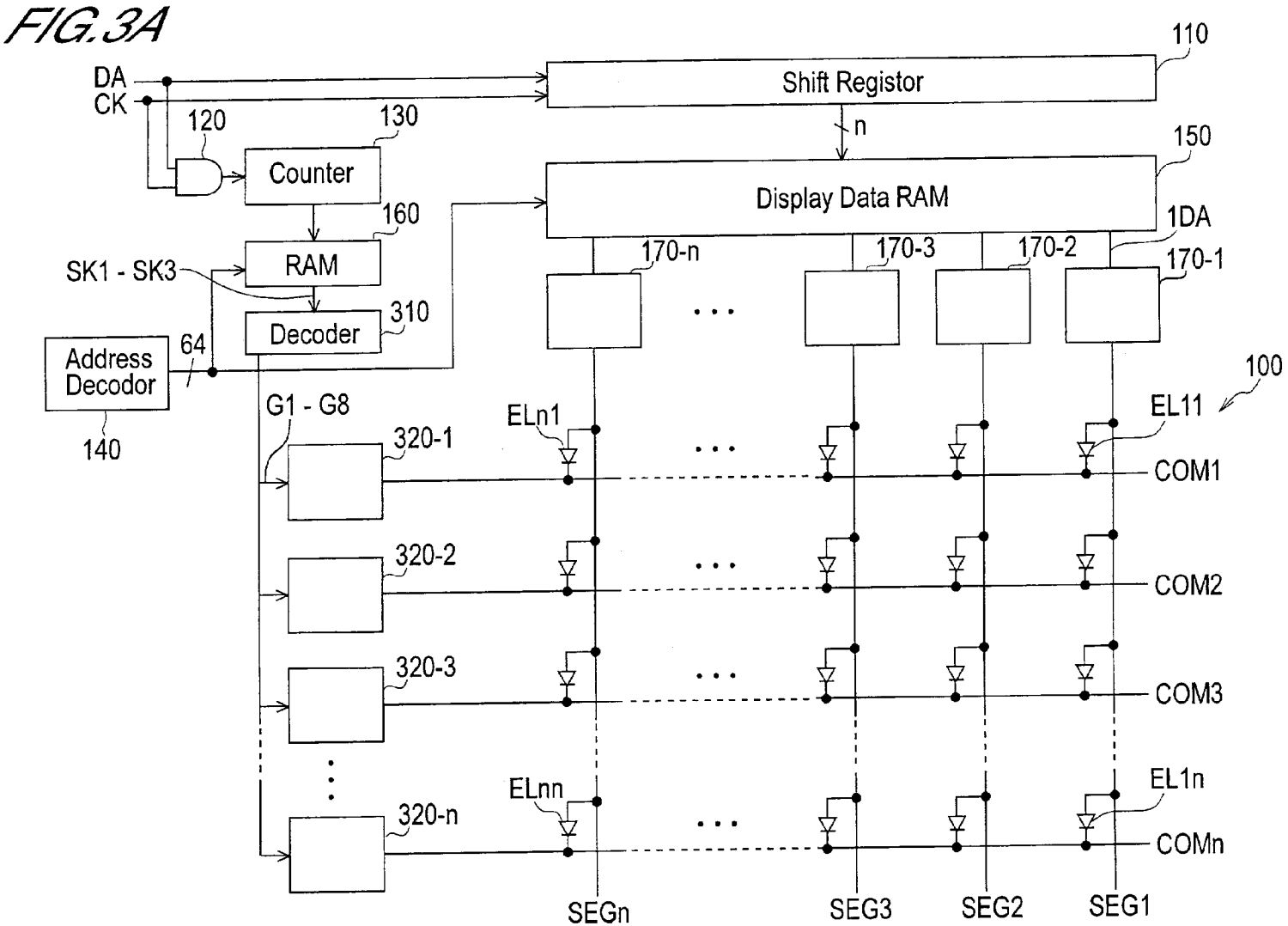
FIG. 3A is a circuit diagram illustrating the overall layout of a display device according to a second embodiment.
Figure 3B:
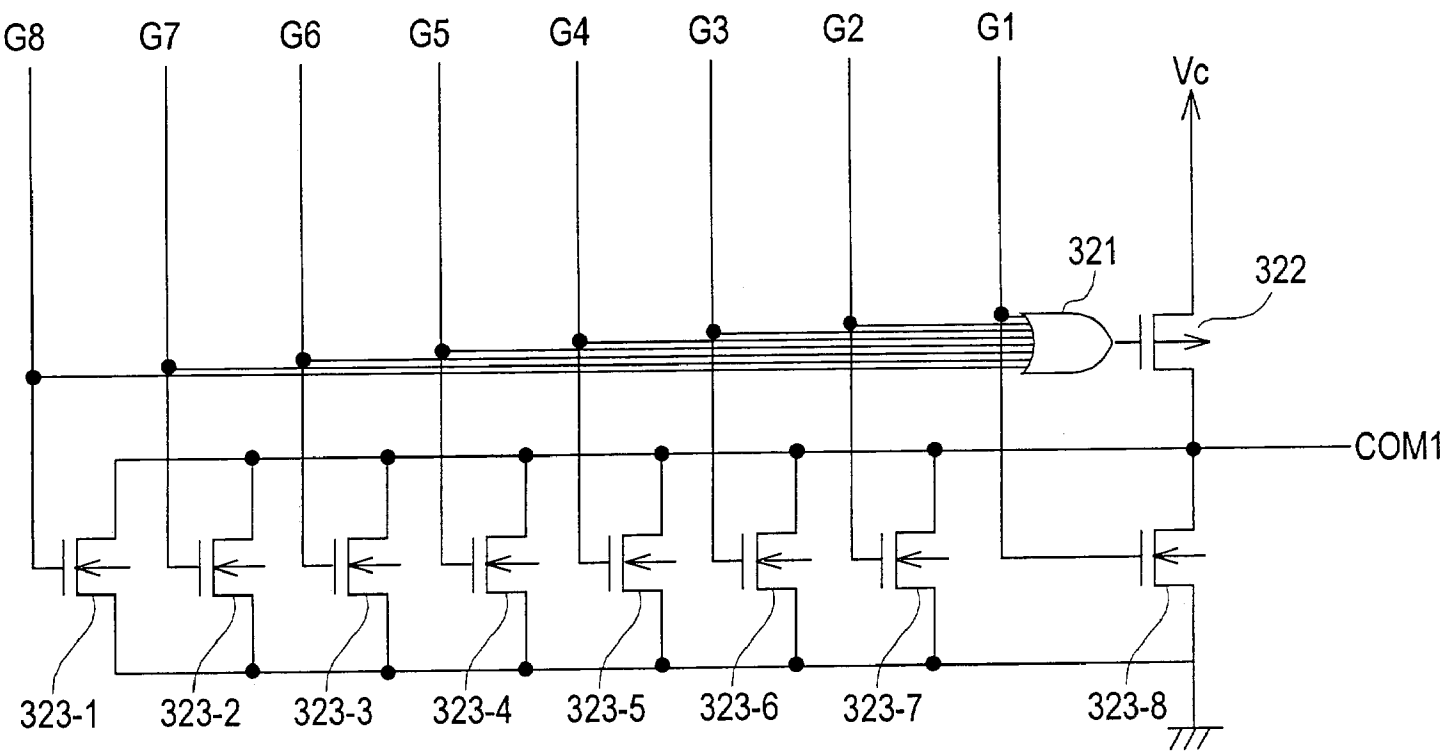
FIG. 3B is a circuit diagram illustrating an example layout of a positive electrode output circuit illustrated in FIG. 3A.

FIG. 3A and FIG. 3B are circuit diagrams illustrating the layout of a display device according to a second embodiment of the present invention. In FIG. 3A, structural elements given the same reference symbols as in FIG. 1A are respectively the same as in FIG. 1A.

As shown in FIG. 3A, a display device according to this embodiment comprises a decoder 310. In addition, the internal construction of negative electrode output circuits 320-1 to 320-n of the display device of this embodiment differs from the first embodiment.

Decoder 310 inputs a negative electrode control signal from negative electrode control RAM 160 and outputs gate control signals. Here, outputs gate control signals G1, G2, . . . , G8 are input to the negative electrode output circuits 320-1. The number of gate control signals and G1 to G8 which are high-level signals is determined in accordance with the value of the binary number indicated by the negative electrode control signal. For example, when the value of the negative electrode control signal is 000, only signal G1 is set to high level; when the value of the negative electrode control signal is 001, gate control signals G1 and G2 are set to high level; and when the value of the negative electrode control signal is 010 the gate control signals G1, G2 and G3 are set to high level. When the value of the negative electrode control signal is 111, all of the gate control signals G1 to G8 are set to high level. In this embodiment, the higher three bits of the count value of the display number counter 130 are employed as the value of the negative electrode control signal. The number of high-level gate control signals therefore increases when the count value becomes larger.

The negative electrode output circuits 320-1 to 320-n discharge to the ground line the current output from the cathodes of organic EL elements EL11 to ELnn through scanning lines COM1 to COMn. As shown in FIG. 3B, negative electrode output circuit 320-1 comprises an OR gate 321, a pMOS transistor 322, and eight nMOS transistors 323-1, 323-2, . . . , 323-8. OR gate 321 outputs the logical sum of signals G1 to G8. pMOS transistor 322 is connected at its source with power source Vc being provided to the scanning line (for example 20 volt), is connected at its drain with scanning line COM1 and is connected at its gate with the output of OR gate 321. nMOS transistors 323-1 to 323-8 are connected at their sources with the ground line, are connected at their drains with scanning line COM1 and input corresponding signals G1 to G8 from their gates. The ON resistances of nMOS transistors 323-1 to 323-8 are the same. The constructions of the other negative electrode output circuits 320-2 to 320-n are the same as the construction of negative electrode output circuit 320-1.

Next, the principles of operation of a display device according to this embodiment will be described. Hereinbelow the description will be given taking as an example the case where n=128.

The operation of reading display data DA is the same as in the case of the first embodiment, so the description thereof will not be repeated.

Hereinbelow, the operation of displaying the first row of display panel 100 will be described. The operation of displaying the second and subsequent rows of display panel 100 is the same as in the case of the first row.

Address decoder 140 outputs address signal A corresponding to the display data of the first row. This address signal A is input to RAM 150 and 160. Display data RAM 150 outputs 128-bit data/DA (i.e. the inverted value of display data DA) corresponding to address signal A to the positive electrode output circuits 170-1 to 170-n. Also, negative electrode control RAM 160 outputs negative electrode control signals G1 through G8 to negative electrode output circuit 180-1.

Positive electrode output circuits 170-1 to 170-n (n=128) input the corresponding bits of the data/DA. As described above, when the data/DA is low-level, positive electrode output circuits 170-1 to 170-n output high level and when the bit signal is high level output low level (see FIG. 1B). The outputs of positive electrode output circuits 170-1 to 170-n are applied to the anodes of the organic EL elements EL11 to ELnn through data lines SEG1 to SEGn.

Decoder 310 inputs negative electrode control signals SK1, SK2 and SK3. Also, as described above, decoder 310 makes some or all of the gate control signals G1 to G8 high level and makes the other gate control signals low level. In this way, the nMOS transistors corresponding to the high-level gate control signals are turned ON and the nMOS transistors corresponding to the low-level gate control signals are turned OFF. Since some or all of the nMOS transistors 323-1 to 323-8 are ON, scanning line COM1 is low level.

As a result, forward voltage is applied to the organic EL elements which have high-level potential applied to their anodes but the voltage between the anode and cathode of the organic EL elements which have low-level potential applied to their anodes is zero volts. For example, when positive electrode output circuit 170-1 outputs high level and the other positive electrode output circuits 170-2 to 170-n output low level, forward voltage is applied to the organic EL element EL11, so this emits light but the other organic EL elements do not emit light.

As described above, in this embodiment, the number of high-level gate control signals becomes larger as the count value of the display number counter 130 becomes larger. Consequently, in the case of negative electrode output circuit 320-1, more nMOS transistors are turned ON as the count value becomes larger. The resistance of negative electrode output circuit 320-1 is the combined ON resistance of the nMOS transistors that are turned ON. The resistance of negative electrode output circuit 320-1 therefore becomes smaller as the count value is increased. With the display device of this embodiment, changes of the voltage between the anodes and cathode of the organic EL elements can therefore be suppressed and, as a result, changes in the light emission intensity of the organic EL elements EL can be suppressed.

In this embodiment, the resistance of the negative electrode output circuits 320-1 to 320-n was controlled using eight nMOS transistors; however, nine or more transistors or seven or less transistors could be employed.

Third Embodiment

Figure 4A:
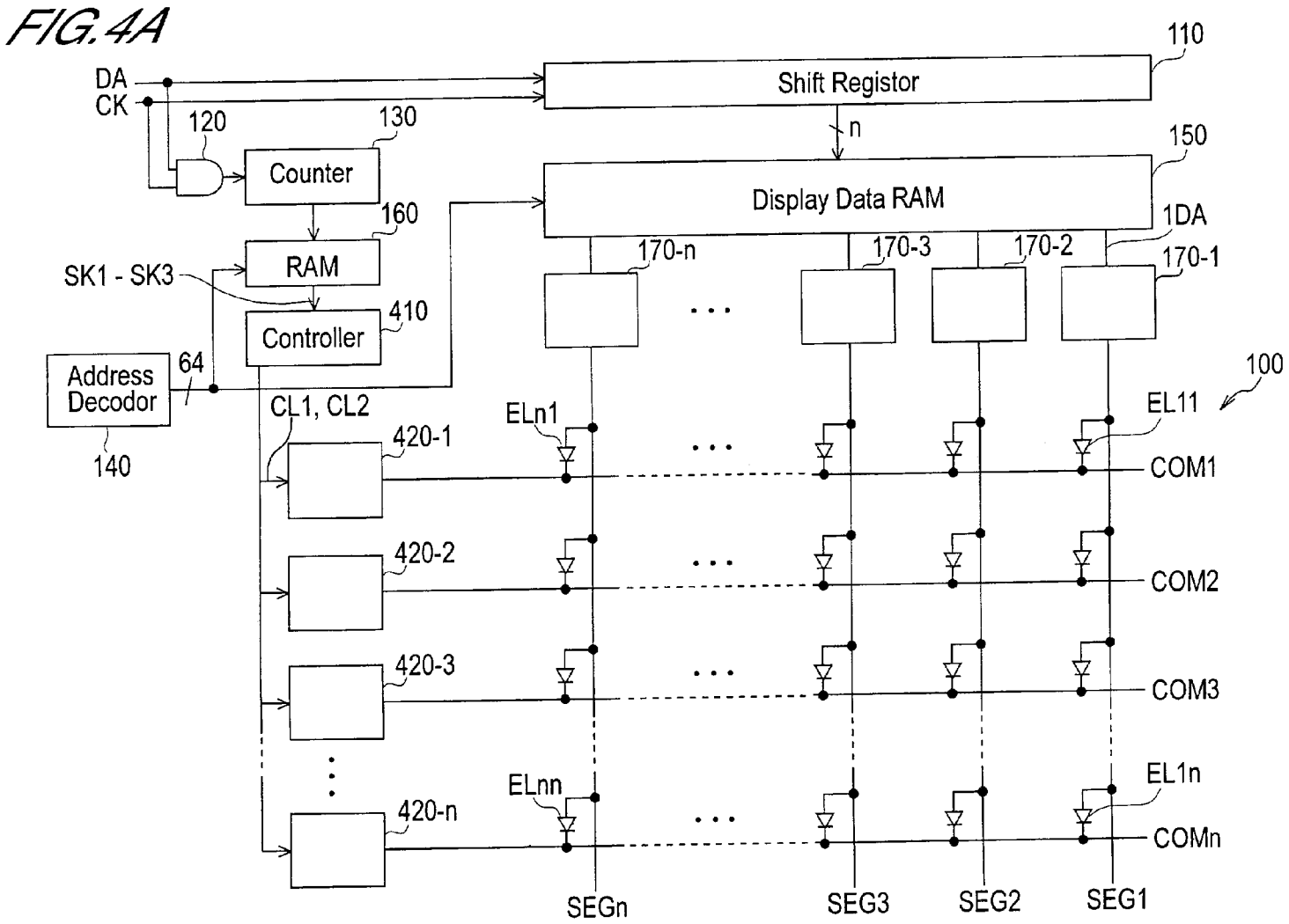
FIG. 4A is a circuit diagram illustrating the overall layout of a display device according to a third embodiment.
Figure 4B:
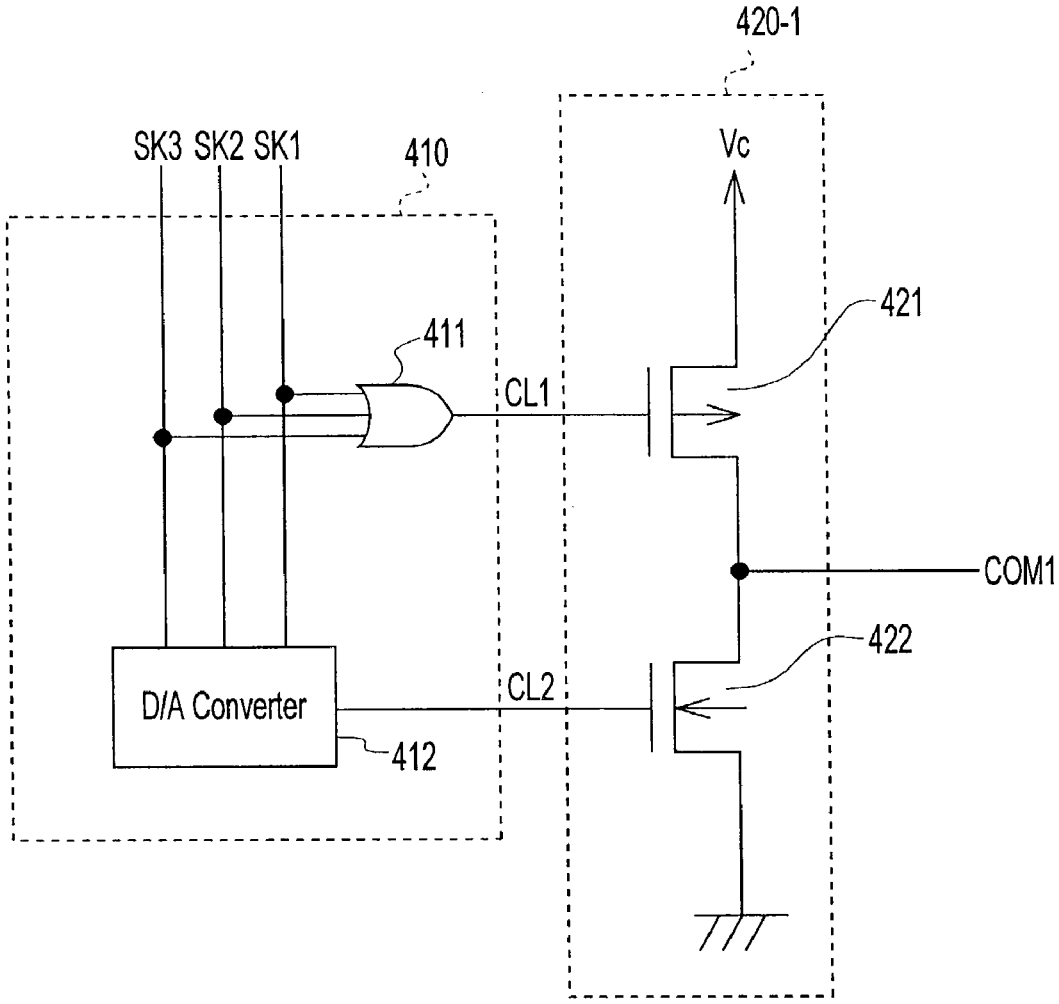
FIG. 4B is a circuit diagram illustrating an example layout of a positive electrode output circuit illustrated in FIG. 4A.

FIGS. 4A and 4B is a circuit diagram illustrating the construction of a display device according to a third embodiment of the present invention. In FIG. 4A structural elements that have the same reference symbols as in FIG. 1A are respectively the same as in FIG. 1A.

As shown in FIG. 4A and FIG. 4B, a display device according to this embodiment comprises a negative electrode controller 410. Furthermore, the internal structure of the negative electrode output circuits 420-1 to 420-n of the display device of this embodiment is different from that of the first embodiment.

FIG. 4B is a circuit diagram illustrating the internal structure of negative electrode controller 410 and negative electrode output circuit 420-1. Only portions of the negative electrode controller 410 of FIG. 4B that are associated with negative electrode output circuit 420-1 are illustrated.

Negative electrode controller 410 comprises an OR gate 411 and a digital/analogue converter 412. OR gate 411 inputs negative electrode control signals SK1, SK2 and SK3 from negative electrode control RAM 160 and outputs the logical sum of these signals as control signal CL1. Digital/analogue converter 412 inputs the signal values of the negative electrode control signals SK1 to SK3 as 3-bit binary information and outputs an analogue voltage signal CL2 of a value corresponding to this information.

Negative electrode output circuit 420-1 comprises a pMOS transistor 421 and nMOS transistor 422. pMOS transistor 421 is connected at its source with power source Vc (for example 20 volt) and is connected at its drain with scanning line COM1 and inputs signal CL1 from its gate. nMOS transistor 422 is connected at its source with the ground line and is connected at its drain with scanning line COM1 and inputs signal CL2 from its gate.

Next the principles of operation of a display device according to this embodiment will be described. Hereinbelow the case where n=128 will be taken as an example.

The operation of reading display data DA is the same as in the case of the first embodiment so the description thereof will not be repeated.

The operation of displaying the first row of display panel 100 will now be described. The operation of displaying the second and subsequent rows of display panel 100 is same as in the case of the first row.

Address decoder 140 outputs address signal A corresponding to the display data of the first row. This address signal A is input to RAM 150 and 160. Display data RAM 150 outputs 128 bit data/DA (i.e. the inverted value of the display data DA) corresponding to address signal A to positive electrode output circuits 170-1 to 170-n. Also, negative electrode control RAM 160 outputs negative electrode control signals SK1, SK2 and SK3 to negative electrode controller 410.

Positive electrode output circuits 170-1 to 170-n (n=128) output corresponding bits of the data/DA. As described above, positive electrode output circuits 170-1 to 170-n output high level when data/DA is low level and output low level when the bit signal is high level (see FIG. 1B). The outputs of positive electrode output circuits 170-1 to 170-n are applied to the anodes of organic EL elements EL11 to ELnn through data lines SEG1 to SEGn.

Negative electrode controller 410 inputs negative electrode control signals SK1 to SK3. The output CL1 of OR gate 411 is high-level except for when all of signals SK1 to SK3 are zero. pMOS transistor 421 is therefore OFF. Also, digital/analogue converter 412 outputs analogue voltage CL2. Consequently, nMOS transistor 422 is turned ON. As a result, scanning line COM1 becomes low-level i.e. ground potential. Consequently, in the same way as in the first embodiment described above, of the organic EL elements EL11, EL21, . . . , ELn1 that are connected with scanning line COM1, the organic EL elements that are connected with high-level data lines emit light.

As described above, the value of the analogue voltage signal CL2 changes in accordance with the values of negative electrode control signals SK1 to SK3, so the ON resistance of nMOS transistor 422 changes in accordance with the values of signals SK1 to SK3. Specifically, the ON resistance of nMOS transistor 422 becomes smaller as the count value of counter 130 becomes larger. Consequently, with the display device of this embodiment, changes of the voltage between the anode and cathode of the organic EL elements can be suppressed, so, as a result, changes of light emission intensity of the organic EL elements EL can be suppressed.

With the display device of this embodiment, the ON resistance of the scanning line is controlled solely by a single nMOS transistor 422, so the number of transistors can be reduced.

In this embodiment, the negative electrode control signals were 3-bit signals, but they could be signals of four bits or more and they could be signals of two bits. The precision of control of the ON resistance can be increased as the number of bits is increased.

The number of organic EL elements of the display panel 100 is not restricted but the advantages of the present invention become more marked as the number of organic EL elements becomes larger.

In the first to the third embodiments, display panel 100 was constituted by organic EL elements, but the present invention could also be applied to display panels employing light-emitting elements of other types, for example light-emitting diodes.

What is claimed is:

1. A display device comprising:

a display panel comprising light-emitting elements arranged in matrix fashion;

a plurality of data lines that apply anode potential to said light-emitting elements of respective columns;

a plurality of scanning lines that apply cathode potential to said light-emitting elements of respective rows;

a positive electrode output circuit that has one row of display data input thereto in parallel and supplies high-level potential or low-level potential to said data lines in accordance with said display data;

a negative electrode output circuit which supplies low-level potential to one of said scanning lines, and which comprises a switch that changes a connection resistance between a ground line and said one of said scanning lines in accordance with a number of said light-emitting elements that emit light simultaneously;

a control circuit which has a counter that counts the number of said light-emitting elements that emit light simultaneously, using said one row of display data; and a signal generating circuit that generates a negative electrode control signal using a count result of said counter, wherein the connection resistance of said switch of said negative electrode output circuit changes in accordance with a value of said negative electrode control signal, wherein said switch comprises a plurality of switching transistors that are connected in parallel between said ground line and said one of said scanning lines, and that have said negative electrode control signal input to control terminals thereof, and wherein ON resistances of said switching transistors are mutually different.

2. The display device according to claim 1, wherein said switch changes said connection resistance by turning ON any one of said switching transistors in accordance with the value of said negative electrode control signal.

3. The display device according to claim 1, wherein said switch comprises:

a decoder that turns ON some or all of said switching transistors responsive to the value of said negative electrode control signal.

4. The display device according to claim 1, wherein said signal generating circuit includes memory that stores the count result of said counter.

5. The display device according to claim 4, wherein said signal generating circuit generates said negative electrode control signal using a prescribed number of higher bits of said count result.

6. The display device according to claim 1, wherein said positive electrode output circuit comprises:

a constant-current circuit having an input terminal connected with a power source line for positive electrodes of said light emitting elements;

a first transistor of a first conductivity type having one end which is connected to an output terminal of said constant-current circuit and having another end which is connected to a corresponding one of said data lines, and that has corresponding display data input to a control terminal thereof; and a second transistor of a second conductivity type having one end which is connected to the ground line and having another end which is connected to the corresponding one of said data lines, and that has said corresponding display data in put to a control terminal thereof.

7. The display device according to claim 1, wherein said negative electrode output circuit provides a plurality of electrode control signals, said negative electrode output circuit further comprising a transistor having one end which is connected with a power source line for negative electrodes of said light-emitting elements, and having another end which is connected with said one of said scanning lines, and that has a logical sum of the electrode control signals input to a control terminal thereof.

8. The display device according to claim 1, wherein said light-emitting elements are organic electroluminescence elements.

9. The display device according to claim 1, wherein said light-emitting elements are light-emitting diodes.

10. A display device comprising:

a display panel comprising light-emitting elements arranged in matrix fashion;

a plurality of data lines that apply anode potential to said light-emitting elements of respective columns;

a plurality of scanning lines that apply cathode potential to said light-emitting elements of respective rows;

a positive electrode output circuit that has one row of display data input thereto in parallel and supplies high-level potential or low-level potential to said data lines in accordance with said display data;

a negative electrode output circuit which supplies low-level potential to one of said scanning lines, and which comprises a switch that changes a connection resistance between a ground line and said one of said scanning lines in accordance with a number of said light-emitting elements that emit light simultaneously;

a control circuit which has a counter that counts the number of said light-emitting elements that emit light simultaneously, using said one row of display data;

a signal generating circuit that generates a negative electrode control signal using a count result of said counter, wherein the connection resistance of said switch of said negative electrode output circuit chances in accordance with a value of said negative electrode control signal;

a plurality of switching transistors connected in parallel between said one of said scanning lines and said ground line; and a decoder that turns ON some or all of said switching transistors responsive to the value of said negative electrode control signal, wherein ON resistance of all of said switching transistors are the same.

11. The display device according to claim 10, wherein said switch changes the connection resistance by changing a number of said switching transistors that are in an ON state in accordance with the value of said negative electrode control signal.

12. The display device according to claim 10, wherein said light-emitting elements are organic electroluminescence elements.

13. The display device according to claim 10, wherein said light-emitting elements are light-emitting diodes.

14. A display device comprising:

a display panel comprising light-emitting elements arranged in matrix fashion;

a plurality of data lines that apply anode potential to said light-emitting elements of respective columns;

a plurality of scanning lines that apply cathode potential to said light-emitting elements of respective rows;

a positive electrode output circuit that has one row of display data input thereto in parallel and supplies high-level potential or low-level potential to said data lines in accordance with said display data;

a negative electrode output circuit which supplies low-level potential to one of said scanning lines, and which comprises a switch that changes a connection resistance between a ground line and said one of said scanning lines in accordance with a number of said light-emitting elements that emit light simultaneously;

a control circuit which has a counter that counts the number of said light-emitting elements that emit light simultaneously, using said one row of display data;

a signal generating circuit that generates a negative electrode control signal using a count result of said counter, wherein the connection resistance of said switch of said negative electrode output circuit changes in accordance with a value of said negative electrode control signal, and wherein said switch comprises a switching transistor which is connected between said ground line and said one of said scanning lines, and that chanaes ON resistance in accordance with an electric potential of a control signal; and a converter that generates said control signal, wherein the electric potential of said control signal depends on the value of said negative electrode control signal, wherein said switching transistor is a field-effect transistor and said converter converts the value of said negative electrode-control signal from a digital value to an analog voltage.

15. The display device according to claim 14, wherein said light-emitting elements are organic electroluminescence elements.

16. The display device according to claim 14, wherein said light-emitting elements are light-emitting diodes.

17. A display device comprising:

a display panel comprising light-emitting elements arranged in matrix fashion;

a plurality of data lines that apply anode potential to said light-emitting elements of respective columns;

a plurality of scanning lines that apply cathode potential to said light-emitting elements of respective rows;

a positive electrode output circuit that has one row of display data input thereto in parallel and supplies high-level potential or low-level potential to said data lines in accordance with said display data;

a negative electrode output circuit which supplies low-level potential to one of said scanning lines, and which comprises a switch that changes a connection resistance between a ground line and said one of said scanning lines in accordance with a number of said light-emitting elements that emit light simultaneously;

a control circuit which has a counter that counts the number of said light-emitting elements that emit light simultaneously, using said one row of display data; and a signal generating circuit that generates a negative electrode control signal using a count result of said counter, wherein the connection resistance of said switch of said negative electrode output circuit changes in accordance with a value of said negative electrode control signal, and wherein said signal generating circuit includes memory that stores the count result of said counter.

18. The display device according to claim 17, wherein said light-emitting elements are organic electroluminescence elements.

19. The display device according to claim 17, wherein said light-emitting elements are light-emitting diodes.

20. A display device comprising:

a display panel comprising light-emitting elements arranged in matrix fashion;

a plurality of data lines that apply anode potential to said light-emitting elements of respective columns;

a plurality of scanning lines that apply cathode potential to said light-emitting elements of respective rows;

a positive electrode output circuit that has one row of display data input thereto in parallel and supplies high-level potential or low-level potential to said data lines in accordance with said display data; and a negative electrode output circuit which supplies low-level potential to one of said scanning lines, and which comprises a switch that changes a connection resistance between a ground line and said one of said scanning lines in accordance with a number of said light-emitting elements that emit light simultaneously, wherein said positive electrode output circuit comprises a constant-current circuit having an input terminal connected with a power source line for positive electrodes of said light emitting elements, a first transistor of a first conductivity type having one end which is connected to an output terminal of said constant-current circuit and having another end which is connected to a corresponding one of said data lines, and that has corresponding display data input to a control terminal thereof, and a second transistor of a second conductivity type having one end which is connected to the ground line and having another end which is connected to the corresponding one of said data lines, and that has said corresponding display data input to a control terminal thereof.

21. The display device according to claim 20, wherein said light-emitting elements are organic electroluminescence elements.

22. The display device according to claim 20, wherein said light-emitting elements are light-emitting diodes.

23. A display device comprising:

a display panel comprising light-emitting elements arranged in matrix fashion;

a plurality of data lines that apply anode potential to said light-emitting elements of respective columns;

a plurality of scanning lines that apply cathode potential to said light-emitting elements of respective rows;

a positive electrode output circuit that has one row of display data input thereto in parallel and supplies high-level potential or low-level potential to said data lines in accordance with said display data; and a negative electrode output circuit which supplies low-level potential to one of said scanning lines, and which comprises a switch that changes a connection resistance between a ground line and said one of said scanning lines in accordance with a number of said light-emitting elements that emit light simultaneously, wherein said negative electrode output circuit provides a plurality of electrode control signals, said negative electrode output circuit further comprising a transistor having one end which is connected with a power source line for negative electrodes of said light-emitting elements, and having another end which is connected with said one of said scanning lines, and that has a logical sum of the electrode control signals input to a control terminal thereof.

24. The display device according to claim 23, wherein said light-emitting elements are organic electroluminescence elements.

25. The display device according to claim 23, wherein said light-emitting elements are light-emitting diodes.

* * * * *